US007982655B2

(12) United States Patent
Zahavi et al.

(10) Patent No.: US 7,982,655 B2
(45) Date of Patent: Jul. 19, 2011

(54) AIRCRAFT DECOY ARRANGEMENT

(75) Inventors: Dov Zahavi, Haifa (IL); Shlomo Tangy, Haifa (IL)

(73) Assignees: Elbit Systems Ltd., Haifa (IL); Elisra Electronic Systems Ltd., Bene Beraq (IL)

( * ) Notice: Subject to any disclaimer, the term of this patent is extended or adjusted under 35 U.S.C. 154(b) by 0 days.

(21) Appl. No.: 12/992,485

(22) PCT Filed: May 13, 2009

(86) PCT No.: PCT/IL2009/000484

§ 371 (c)(1),
(2), (4) Date: Nov. 12, 2010

(87) PCT Pub. No.: WO2009/138983

PCT Pub. Date: Nov. 19, 2009

(65) Prior Publication Data

US 2011/0068223 A1 Mar. 24, 2011

(30) Foreign Application Priority Data

May 14, 2008 (IL) ..... 191445

(51) Int. Cl.
*G01S 7/36* (2006.01)

(52) U.S. Cl. ..... 342/15; 342/13; 342/14; 244/1 TD

(58) Field of Classification Search ..... 342/9, 13, 342/14, 15; 244/1 TD
See application file for complete search history.

(56) References Cited

U.S. PATENT DOCUMENTS

| | | | | |
|---|---|---|---|---|
| 3,760,417 | A * | 9/1973 | Haeff et al. | 342/15 |
| 4,808,999 | A * | 2/1989 | Toman | 342/15 |
| 5,260,820 | A * | 11/1993 | Bull et al. | 398/125 |
| 6,055,909 | A * | 5/2000 | Sweeny | 102/336 |
| 6,429,800 | B1 * | 8/2002 | Richmond | 342/14 |
| 6,492,931 | B1 * | 12/2002 | Blitz | 342/15 |

(Continued)

FOREIGN PATENT DOCUMENTS

GB 2303755 A 1/1997

OTHER PUBLICATIONS

Written Opinion of the International Searching Authority; International Application No. PCT/IL2009/000484; International Filing Date: May 13, 2009; 9 pages.

*Primary Examiner* — Tien Dinh
*Assistant Examiner* — Michael Kreiner
(74) *Attorney, Agent, or Firm* — Blank Rome LLP

(57) ABSTRACT

Aircraft decoy arrangement and method for generating a decoy signal from an aircraft having an isolated decoy. An aircraft receiver detects a threat signal from a threat source targeting the aircraft. An aircraft signal processor produces a decoy relay signal based on the threat signal, where the decoy relay signal frequency is significantly lower than the threat signal frequency and is slowly attenuated through air, the signal processor calibrating the decoy relay signal in accordance with a received test signal to compensate for inaccuracies. An aircraft transmitter transmits the decoy relay signal and an optional reference signal to the decoy, where it is received by a decoy receiver, converted back to a decoy signal by a decoy frequency converter, and transmitted by a decoy transmitter, causing the threat source to detect the decoy signal and lock onto the decoy rather than the aircraft.

21 Claims, 3 Drawing Sheets

U.S. PATENT DOCUMENTS

| | | | | |
|---|---|---|---|---|
| 6,804,495 | B2 * | 10/2004 | Duthie | 455/67.11 |
| 7,142,148 | B2 * | 11/2006 | Eneroth | 342/14 |
| 7,184,724 | B1 * | 2/2007 | Ashby et al. | 455/130 |
| 7,711,346 | B2 * | 5/2010 | Ashby et al. | 455/314 |
| 2003/0068981 | A1 | 4/2003 | Duthie | |
| 2005/0179577 | A1 | 8/2005 | Eneroth | |
| 2007/0273963 | A1 | 11/2007 | Marion | |

* cited by examiner

AIRCRAFT DECOY ARRANGEMENT

FIELD OF THE DISCLOSED TECHNIQUE

The disclosed technique relates to aircraft missile defense systems, in general, and to an aircraft decoy arrangement and method for generating and transmitting a decoy signal, in particular.

BACKGROUND OF THE DISCLOSED TECHNIQUE

Anti-aircraft warfare generally involves the launching of rockets or guided missiles that target an aircraft. A guided missile includes a guidance mechanism which directs the missile to lock on to and track a moving target during the missile trajectory (i.e., homing). For example, an infrared homing guided missile, also known as a heat seeking missile, detects the infrared radiation emitted by the target (e.g., the exhaust expelled from the jet engines) to provide guidance. Another type of guidance mechanism is based on radar, in which the missile or a radar ground station transmits radio waves toward the target, and then the missile detects the return signal reflected by the target.

A targeted aircraft may deploy a decoy device to contend with an oncoming guided missile, causing the missile to target the decoy rather than the aircraft. The decoy detects the radar signal transmitted toward the aircraft, and then transmits a decoy signal having the appropriate signal parameters to deceive the missile into identifying the decoy as the intended target (i.e., the aircraft). The missile proceeds to target the decoy, which is eventually destroyed by the missile, while avoiding damage to the aircraft. Such a decoy must contain substantial processing power and capabilities, which adds weight as well as cost, and additional wasted resources once the decoy is destroyed.

It is also possible for the aircraft to detect the signal from the oncoming missile and then to transmit the required data to the decoy. The aircraft may send the decoy operating parameters, such as what type of signal to transmit and in which direction, and may monitor the status of the decoy. The data transmission is generally accomplished with a dedicated data link, such as optical fiber cables connecting the aircraft to the decoy. For example, the decoy may be arranged on a cable drum inside the aircraft, and the cable is released and unraveled outside the aircraft once the decoy is deployed. Such a cable also adds to the overall weight of the aircraft.

The decoy is typically attached to the aircraft, also known as a "towed decoy". Accordingly, the connecting cable can also be used to transmit data between the aircraft and the decoy. If the decoy is detached from the aircraft, the aircraft must transmit data using a wireless communication link. Alternatively, the aircraft may transmit the required data to the decoy prior to deployment, while the decoy is still onboard the aircraft.

A particular problem arises due to the fact that the decoy signal transmitted by the decoy is at a similar frequency to the radar signal detected by the decoy from the missile. The decoy may detect its own transmitted signal and mistakenly consider it to be the radar signal from the missile, resulting in a continuous feedback loop. Similarly, if the aircraft is operative to detect the radar signal and to communicate this information to the decoy, the aircraft may detect the decoy signal transmitted by the decoy and mistakenly consider it to be the radar signal from the missile.

U.S. Pat. No. 7,142,148 to Eneroth, entitled "Towed decoy and method of improving the same", is directed to a towed decoy arrangement for an aircraft having a towed decoy. The aircraft includes a receiving antenna, a transmitting antenna and an analysis and noise signal generating device, which may include the aircraft jamming equipment. The receiving antenna detects a threatening signal from a threat source (e.g., a missile or homing device), and the analysis and noise signal generating device generates a noise signal, which is transformed to a higher frequency that is rapidly attenuated through air. The transmitting antenna transmits the transformed noise signal to the decoy. The frequency of the transformed noise signal is generally higher than 58 GHz, and in particular, at about 77 GHz with a 10 GHz bandwidth. The decoy includes a receiving antenna, means for signal transformation, and a transmitter with a transmitting antenna. The decoy receiving antenna receives the transformed noise signal from the aircraft, and converts the received signal back to a noise signal, by shifting the received signal to the frequency of the threatening signal and amplifying it. The decoy transmitter then transmits the noise signal in the direction of the threat source.

U.S. Pat. No. 6,804,495 to Duthie, entitled "Wireless communicator link from towed/surrogate decoy transmitter to the host aircraft", is directed to a method of communication between a towed decoy transmitter and the host aircraft using a two-way wireless communication link. Both the host aircraft and the towed decoy include an RF wireless transceiver connected via the wireless link. The host aircraft transmits a host RF drive signal through the tow cable (e.g., using fiber optics, modems or coaxial cables) to the decoy. The decoy transmitter transmits an RF electronic countermeasure (ECM) output signal in fore and aft directions, such that an RF based tracking missile will lock on to the decoy rather than the aircraft. Operational control signals, such as to modify performance parameters in the decoy, are transmitted from the host aircraft wireless transceiver to the towed decoy wireless transceiver through the wireless link. The operational control of the decoy can then send an operational adjust signal to the transmitter to modify the relevant parameters. Built-in-test (BIT) circuitry in the decoy monitors performance specifications of the decoy transmitter, and this information can be transmitted as a BIT data signal to the host aircraft wireless transceiver from the towed decoy wireless transceiver. The host aircraft operational controller can then send back commands to adjust or check a performance parameter, or display the information to the pilot. The operational performance information may be communicated through the existing onboard RF ECM antenna on the host aircraft and decoy antenna on the decoy, if available, rather than through the wireless communication link. In circumstances with multiple host aircrafts and decoys, each host aircraft or decoy may transmit or receive data from another host aircraft or decoy. For example, a master host aircraft responsible for overall deployment strategy can control the RF ECM signal of any decoy.

UK Patent No. GB 2,303,755 to Morand, entitled "Electronic counter-measures for towing by an aircraft", is directed to an ECM device for an aircraft, which includes a towed auxiliary device that can be deployed from the aircraft during flight. The auxiliary device is connected to the aircraft with a towing cable. A primary receiver on the aircraft detects incident radioelectric signals relating to a threat, and a generator circuit produces a jamming signal and digital commands. A power supply on the aircraft produces a high voltage, high frequency power current. The jamming signal is transmitted to the auxiliary device via optical fibres arranged around the towing cable, and the logic signals and feed current are transmitted over bifilar metallic links. The feed current powers all the internal circuits of the auxiliary device. The jamming signal is applied to a preamplifier and correcting device, followed by a transmitting amplifier, and an ultra high frequency commutator. The commutator directs transmission of the jamming signal from either a front antenna or a rear antenna, arranged respectively under radomes at the front and back of the auxiliary device. The commutator is controlled by the received logic signals, in accordance with whether the threat is in front of or behind the auxiliary device. The jamming signal may be transmitted over a single optical fibre in a spectral band between 6-18 GHz using a single laser transmission diode. Alternatively, the signal may be transmitted over two optical fibres in two separate frequencies, and recombined at the auxiliary device.

SUMMARY OF THE DISCLOSED TECHNIQUE

In accordance with the disclosed technique, there is thus provided a decoy arrangement for an aircraft having at least one decoy isolated from the aircraft. The decoy may be towed by the aircraft or detached from the aircraft. The aircraft includes an aircraft relay, which includes an aircraft receiver, a signal processor, and an aircraft transmitter. The decoy includes a decoy relay, which includes a decoy receiver, a frequency converter, and a decoy transmitter. The aircraft receiver detects a threat signal, such as a radar signal, from a threat source targeting the aircraft, such as a missile or a ground station associated with the missile. The signal processor produces a decoy relay signal based on the threat signal. The frequency of the decoy relay signal is significantly lower than the frequency of the threat signal, and is slowly attenuated through air. The signal processor may calibrate the decoy relay signal in accordance with a test signal received from the decoy relay, to compensate for inaccuracies in the decoy relay. The aircraft transmitter transmits the decoy relay signal and an optional reference signal to the decoy. The decoy receiver receives the decoy relay signal and optional reference signal from the aircraft. The frequency converter converts the decoy relay signal into a decoy signal, which is transmitted by the decoy transmitter. The threat source detects the decoy signal and locks onto the decoy rather than the aircraft.

In accordance with the disclosed technique, there is further provided a method for generating a decoy signal with an aircraft having at least one decoy isolated from the aircraft. The method includes the procedure of detecting a threat signal, such as a radar signal, from a threat source targeting the aircraft, such as a missile or a ground station associated with the missile. The method further includes the procedure of producing a decoy relay signal based on the detected threat signal. The frequency of the decoy relay signal is significantly lower than the frequency of the threat signal, and is slowly attenuated through air. The decoy relay signal may be calibrated in accordance with a test signal received from the decoy, to compensate for inaccuracies in the decoy. The method further includes the procedures of transmitting the decoy relay signal and an optional reference signal from the aircraft to the decoy, converting the received decoy relay signal to a decoy signal at the decoy, and transmitting the decoy signal from the decoy. The threat source detects the decoy signal and locks onto the decoy rather than the aircraft.

BRIEF DESCRIPTION OF THE DRAWINGS

The disclosed technique will be understood and appreciated more fully from the following detailed description taken in conjunction with the drawings in which.

DETAILED DESCRIPTION OF THE EMBODIMENTS

The disclosed technique overcomes the disadvantages of the prior art by providing a novel aircraft decoy arrangement and method for generating and transmitting a decoy signal from an aircraft to a decoy which is isolated from the aircraft. After a threat is detected at an aircraft, the aircraft determines a decoy signal and produces a decoy relay signal based on the detected threat signal. The frequency of the decoy relay signal is significantly lower than the frequency of the threat signal, and is slowly attenuated through air. The aircraft transmits the decoy relay signal to the decoy. The aircraft may calibrate the decoy relay signal in accordance with a test signal received from the decoy, to compensate for inaccuracies in the decoy. The decoy recovers the decoy signal from the decoy relay signal, and transmits the decoy signal. The decoy signal is detected by the threat source, causing the threat source to target the decoy rather than aircraft.

Figure 1:
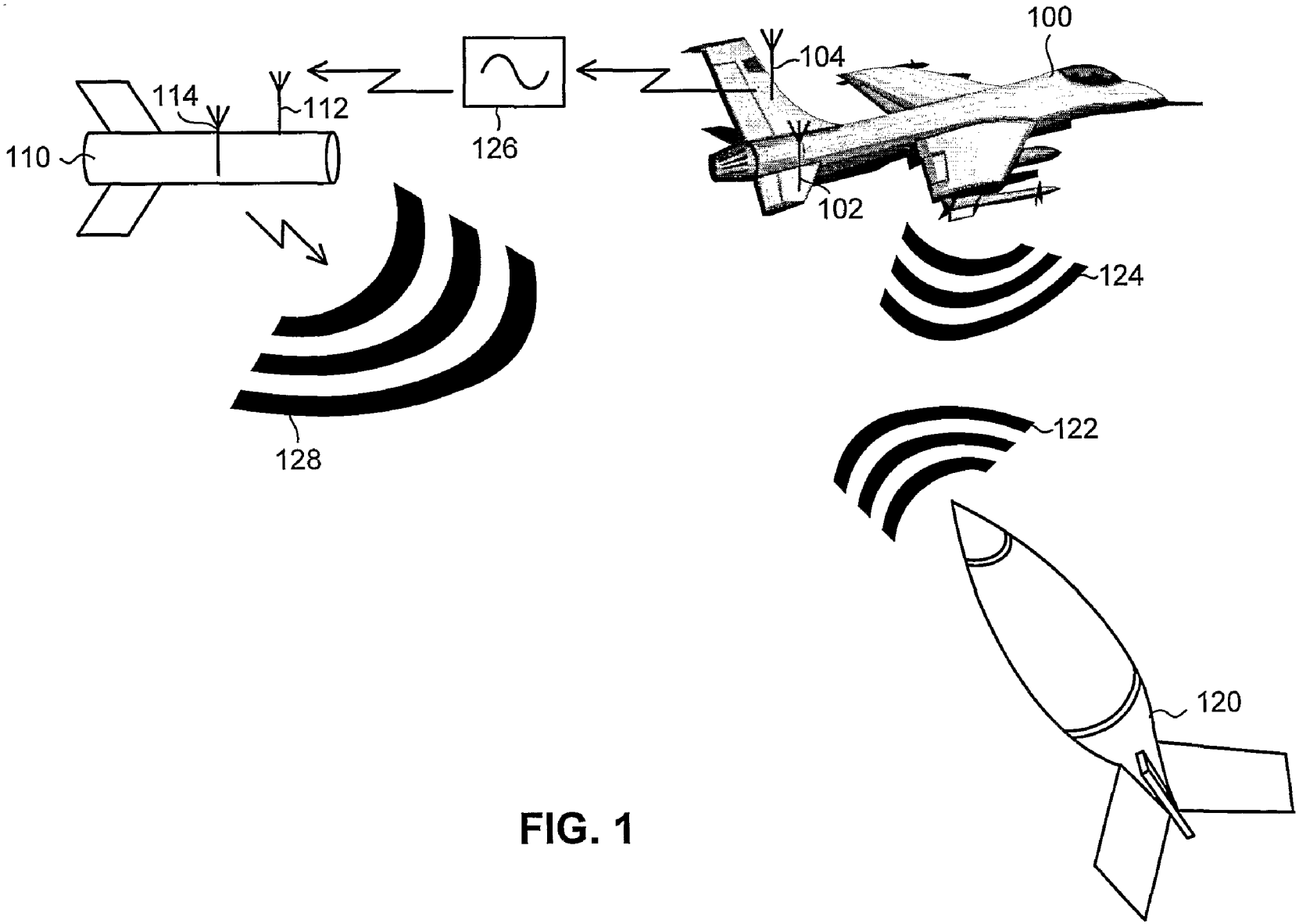
FIG. 1 is a schematic illustration of an aircraft decoy arrangement, constructed and operative in accordance with an embodiment of the disclosed technique.
Figure 2:
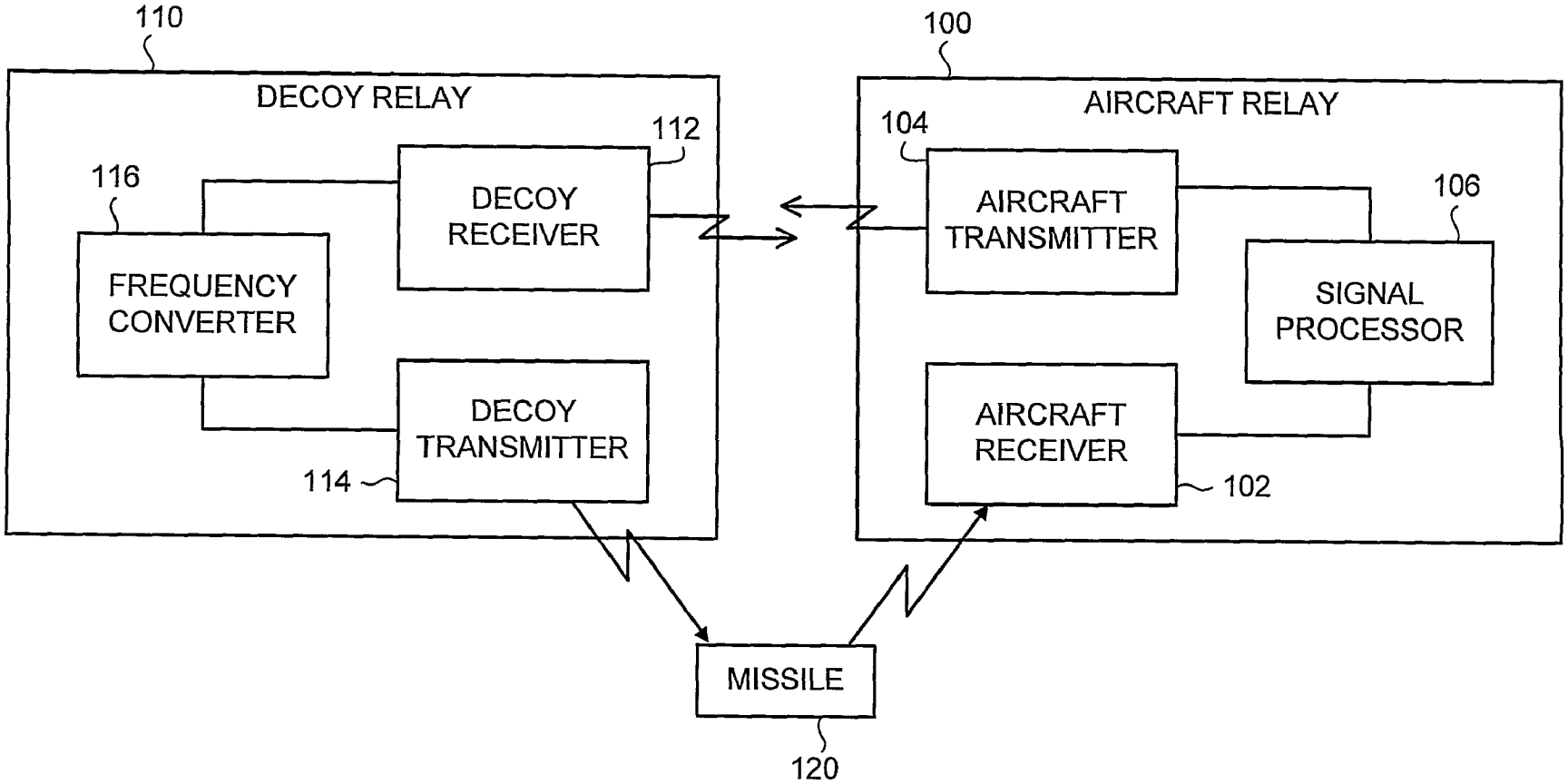
FIG. 2 is a block diagram representation of an aircraft relay and a decoy relay, constructed and operative in accordance with an embodiment of the disclosed technique.

Reference is now made to FIGS. 1 and 2. FIG. 1 is a schematic illustration of an aircraft decoy arrangement, constructed and operative in accordance with an embodiment of the disclosed technique. FIG. 2 is a block diagram representation of an aircraft relay and a decoy relay, constructed and operative in accordance with an embodiment of the disclosed technique. Aircraft 100 is typically a combat aircraft operating in a military environment, such as a bomber, a fighter aircraft, a surveillance aircraft, and the like. Aircraft 100 may be any type of airborne vehicle capable of flight, and includes both fixed-wing aircrafts (e.g., aeroplanes, seaplanes) and rotary-wing aircrafts (e.g., helicopters, gyroplanes).

With reference to FIG. 2, aircraft 100 includes an aircraft relay, which includes an aircraft receiver 102, an aircraft transmitter 104, and a signal processor 106. Signal processor 106 is coupled with aircraft receiver 102 and with aircraft transmitter 104. Aircraft receiver 102 generally includes an antenna and other electric components for receiving signals. Aircraft transmitter 104 generally includes an antenna and other electric components for transmitting signals. Signal processor 106 may be integrated with other aircraft processing units. Aircraft receiver 102 and aircraft transmitter 104 may be implemented by a single antenna.

Aircraft 100 discharges a decoy 110 during flight. Decoy 110 is detached from aircraft 100 (i.e., self-propelled). Alternatively, decoy 110 may be connected to aircraft 100, such as via a towing cable, in which case, aircraft 100 tows decoy 110 after it has been discharged. The discharging of decoy 110 may be performed automatically and controlled by an onboard control system (e.g., a missile warning system), or may be performed manually by the pilot or other aircraft crew member. Decoy 110 may be aerodynamically designed and may include maneuverability means, such as wings or air brakes, to enable decoy 110 to maneuver through the air in a desired trajectory. After being discharged, decoy 110 is situated at a sufficient distance away from aircraft 100 to ensure that no damage results to aircraft 100 if decoy 110 is hit by a weapon, yet close enough to aircraft 100 to ensure that any missile 120 tracking aircraft 100 will also receive signals transmitted by decoy 110, and thus missile 120 will be made to track decoy 110 rather than aircraft 100. Typically, such a distance is between tens of meters to several hundred meters.

With reference to FIG. 2, decoy 110 includes a decoy relay, which includes a decoy receiver 112, a decoy transmitter 114, and a frequency converter 116. Frequency converter 116 is coupled with decoy receiver 112 and with decoy transmitter 114. Decoy receiver 112 generally includes an antenna and other electric components for receiving signals. Decoy transmitter 114 generally includes an antenna and other electric components for transmitting signals. Decoy receiver 112 and decoy transmitter 114 may be implemented by a single antenna. Frequency converter 116 is a basic electronic circuit, which merely translates or shifts the input frequency by a certain amount.

A threat source, such as a guided missile 120, targets aircraft 100. For example, missile 120 may be an active homing missile, which uses a radar system to lock onto the target. Missile 120 emits radar radio waves 122 toward aircraft 100, and detects the radio waves 124 reflected from aircraft 100.

Aircraft receiver 102 detects radar radio waves emanating from missile 120 or from components associated with missile 120, such as a ground station in contact with the missile. Aircraft receiver 102 forwards the detected radar signal to signal processor 106, which generates a decoy signal based on the radar signal. The decoy signal is designed to cause the missile to start tracking the decoy rather than the aircraft. The decoy signal takes into account the change in perceived frequency due to the Doppler effect. The signal processor 106 calculates the frequency of the reflected radar signal as perceived by missile 120 after the Doppler effect is taken into account, based on the velocity vector (i.e., speed in the direction of the missile) of aircraft 100, relative to the velocity vector of missile 120 (in the same direction). For example, if the radar signal is 10 GHz, and the Doppler effect results in a frequency shift of 2 kHz, the generated decoy signal would be 10 GHz +/−4 kHz (the plus-minus sign depending on whether aircraft 100 is travelling toward or away from missile 120), as this is equivalent to the reflected signal that is expected to be detected from aircraft 100. The radar signal is generally on the order of several GHz, and may range anywhere between 1 GHz to 40 GHz. The Doppler shift frequency is generally on the order of several kHz, and may range anywhere between 10 Hz to 100 KHz, which correlates with possible radar signals and the typical relative speeds of aircrafts/decoys respective of missiles.

Signal processor 106 (or an equivalent frequency converter element) converts the decoy signal to a decoy relay signal. The decoy relay signal is in the "S" frequency band (i.e., 2-4 GHz), and is preferably approximately 2 GHz. Accordingly, signal processor 106 shifts the decoy signal by an appropriate amount which would result in a frequency of approximately 2 GHz. Thus, if the decoy signal is established as 10 GHz +/−4 kHz, then this signal is shifted by approximately 8 GHz, to produce a decoy relay signal of 2 GHz +/−4 kHz.

Aircraft transmitter 104 proceeds to transmit the decoy relay signal, referenced 126 (FIG. 1), toward decoy 110. Aircraft transmitter 104 transmits decoy relay signal 126 at a sufficiently high output power (e.g., approximately 10 W) to ensure clear reception by decoy 110.

Decoy receiver 112 receives decoy relay signal 126 from aircraft transmitter 104, and forwards it to frequency converter 116. Frequency converter 116 transforms the decoy relay signal to reproduce the original decoy signal, by applying the appropriate translation or shift to the input decoy relay signal. Thus, if the received decoy relay signal is 2 GHz +/−4 kHz, then frequency converter 116 shifts this frequency by approximately 8 GHz, to produce a decoy signal of 10 GHz +/−4 kHz.

It is noted that the frequency shift factor may be predetermined at both signal processor 106 and frequency converter 116 (e.g., a constant frequency shift of approximately 8 GHz). Alternatively, signal processor 106 may determine the appropriate frequency shift factor to utilize based on the detected radar signal frequency. Aircraft 100 then transmits a reference signal to decoy 110 to indicate the frequency shift factor that has been established.

Frequency converter 116 forwards the recovered decoy signal to decoy transmitter 114, which transmits the decoy signal, referenced 128 (FIG. 1). Decoy transmitter 114 transmits decoy signal 128 at a signal strength sufficient to overcome the radar signal reflected from aircraft 100 (i.e., decoy signal 128 has a greater intensity than reflected radar signal 124), so that missile 120 will detect decoy signal 128 instead of reflected radar signal 124. Decoy transmitter 116 transmits the decoy signal in all directions, or toward a particular direction corresponding with the trajectory of missile 120 (i.e., in accordance with information received from aircraft 100) using a directional antenna.

Once missile 120 detects decoy signal 128, missile 120 locks on to decoy 110. Eventually, missile 120 hits and destroys decoy 110, resulting in no (or minimal) damage to aircraft 100. It is noted that the distance between decoy 110 and aircraft 100 must be sufficiently large such that missile 120 does not lock on to aircraft 100 even after decoy signal 128 has been transmitted by decoy 110. Similarly, decoy signal 128 must be transmitted before missile 120 has reached sufficient proximity to aircraft 100 to have already locked onto aircraft 100.

The frequency of the decoy relay signal is preferably in the "S" frequency band (i.e., 2-4 GHz), and further preferably is approximately 2 GHz, but may generally be any frequency that is significantly lower than the frequency of the threat signal, and which is slowly attenuated through air. It is noted that generating the decoy relay signal involves simple conversion schemes, enabling the decoy to easily respond to radar signals over a wide frequency range. Since the decoy relay signal 126 is transmitted at a frequency that does not rapidly attenuate through the air, decoy relay signal 126 is bound to reach decoy 110, even if decoy 110 is situated quite far from aircraft 100 (e.g., a distance of several hundred meters away). This also allows decoy 110 to be detached (i.e., not towed) from aircraft 100. Furthermore, even if decoy relay signal 126 reaches missile 120, it will not affect the guidance system of missile 120, which will still lock on to decoy 110 after decoy signal 128 has been sent.

Aircraft 100 may initiate a calibration process to compensate for frequency drifts or other inaccuracies in frequency converter 116 of decoy 110. Such inaccuracies could potentially lead to decoy signal 128 being slightly different than what was intended. Aircraft 100 requests from decoy 110 to transmit a test signal prior to the transmission of decoy relay signal 126. Aircraft 100 detects the test signal, and calibrates the decoy relay signal in accordance with the detected test signal. For example, if decoy 110 transmits a test signal of 8 GHz +0.5 kHz (i.e., introducing an error of +0.5 kHz), then signal processor 106 of aircraft 100 compensates for the anticipated error, by subtracting 0.5 kHz from decoy relay signal 126. As a result, the decoy signal 128 will still be accurate, even after the error introduced by frequency converter 116 of decoy 110. This calibration process facilitates the implementation of decoy 110 with a small, low power consumption, and inexpensive frequency converter.

It is noted that decoy 110 contains minimal hardware and processing power. Decoy 110 simply includes basic transmitter and receiver components and a simple frequency converter, resulting in minimal weight and cost. The majority of the processing capability required to generate and transmit the appropriate decoy signal is disposed on aircraft 100.

If decoy 110 is detached from aircraft 100 (i.e., not towed), then signal processor 106 must account for the additional Doppler effect between aircraft 100 and decoy 110 when calculating the required decoy signal to be transmitted by decoy 100. Accordingly, signal processor 106 compensates for the additional Doppler effect between the aircraft 100 and decoy 100, as well as the Doppler effect between aircraft 100 and missile 120.

Aircraft 100 may contain multiple decoys similar to decoy 110, to deal with threats from multiple sources. Aircraft 100 may discharge multiple decoys simultaneously. If decoy 110 is towed, than aircraft 100 may reuse decoy 110 for another threat if it remains usable after a first threat has subsided.

Aircraft receiver 102 may identify a detected signal as being a decoy signal (transmitted by decoy transmitter 114), based on certain characteristics, such as the direction or a specific type of modulation imposed on the signal. Accordingly, signal processor 106 adds a "feedback loop prevention code" to the decoy relay signal, which can be identified by aircraft 100. As a result, aircraft 100 will not mistakenly consider a detected decoy signal as being a radar. signal, thereby avoiding an erroneous "feedback loop" between the aircraft and the decoy. The feedback loop prevention code is designed such that it is not noticeable by missile 120, and will not interfere with the missile guidance and tracking mechanism. Aircraft 100 may instruct decoy 110 not to transmit any signals until after decoy 110 has received decoy relay signal 126, to prevent any undesirable transmissions and interference.

Figure 3:
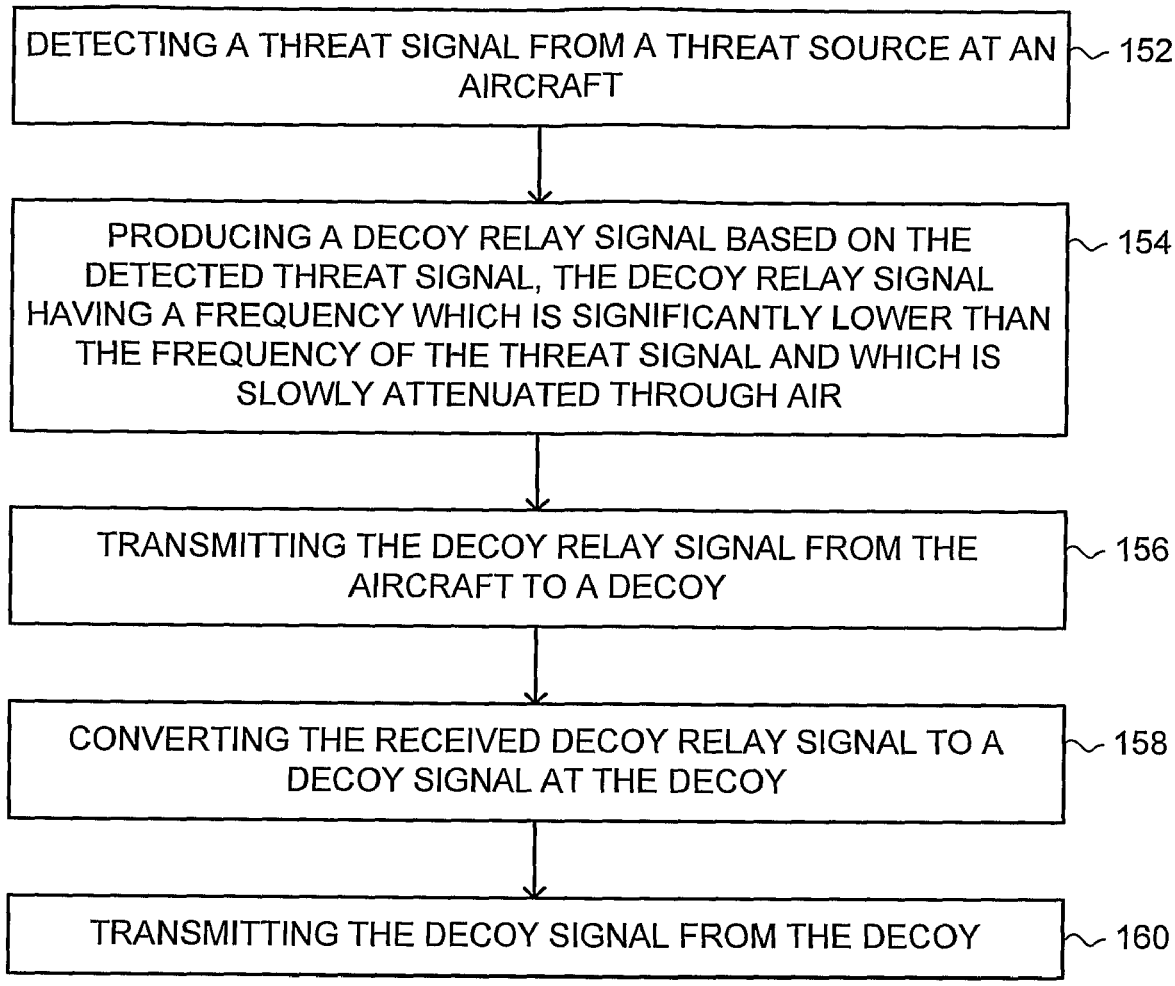
FIG. 3 is a schematic illustration of a method for generating a decoy signal with an aircraft having a decoy, operative in accordance with another embodiment of the disclosed technique.

Reference is now made to FIG. 3, which is a schematic illustration of a method for generating a decoy signal with an aircraft having a decoy, operative in accordance with another embodiment of the disclosed technique. In procedure 152, a threat signal from a threat source is detected at an aircraft. With reference to FIG. 1, aircraft receiver 102 detects a radar radio signal 122 transmitted by missile 120 or a ground station associated with missile 120.

In procedure 154, a decoy relay signal is produced based on the detected threat signal, the decoy relay signal having a frequency which is significantly lower than the frequency of the threat signal, and which is slowly attenuated through the air. With reference to FIG. 2, signal processor 106 transforms radar signal 122 to a decoy signal (which takes into account the change in perceived frequency of the aircraft due to the Doppler effect), and then shifts the decoy signal by an appropriate amount to produce a decoy relay signal. The decoy relay signal is preferably at a frequency in the "S-band", and further preferably is approximately 2 GHz. Alternatively, signal processor 106 directly determines decoy relay signal based on the detected threat signal. Signal processor 106 further optionally adds a particular code or feature to the decoy relay signal (i.e., a "feedback loop prevention code"), such as a particular type of modulation, to ensure that aircraft 100 does not mistakenly consider a detected decoy signal as being a threat signal.

In procedure 156, a decoy relay signal is transmitted from the aircraft to a decoy. With reference to FIG. 1, aircraft transmitter 104 transmits a decoy relay signal 126 to decoy receiver 112 of decoy 110, after decoy 110 has been discharged from aircraft 100. Aircraft transmitter 104 may optionally also transmit a reference signal to decoy 110, for use in determining the decoy signal.

In procedure 158, the received decoy relay signal is converted to a decoy signal at the decoy. With reference to FIG. 2, frequency converter 116 converts decoy relay signal 126 to a decoy signal.

In procedure 160, the decoy signal is transmitted from the decoy. With reference to FIG. 1, decoy transmitter 114 transmits decoy signal 128. Decoy signal 128 reaches missile 120, which locks on to decoy 110 instead of aircraft 100.

It will be appreciated by persons skilled in the art that the disclosed technique is not limited to what has been particularly shown and described hereinabove.

The invention claimed is:

1. A decoy arrangement for an aircraft having at least one decoy isolated from said aircraft, said arrangement comprising an aircraft relay disposed in said aircraft, and a decoy relay disposed in said decoy, said aircraft relay comprising:

an aircraft receiver, for detecting a threat signal from a threat source;

a signal processor, for producing a decoy relay signal based on said threat signal, said decoy relay signal having a frequency which is significantly lower than the frequency of said threat signal, and which is slowly attenuated through air; and an aircraft transmitter, for transmitting said decoy relay signal to said decoy, said decoy relay comprising:

a decoy receiver, for receiving said decoy relay signal from said aircraft;

a frequency converter, for converting said decoy relay signal into a decoy signal; and a decoy transmitter, for transmitting said decoy signal.

2. The arrangement according to claim 1, wherein the frequency of said decoy relay signal is between approximately 2-4 GHz.

3. The arrangement according to claim 1, wherein said decoy signal is transmitted at an intensity which is greater than the intensity of the reflection of said threat signal reflecting from said aircraft.

4. The arrangement according to claim 1, wherein said decoy is towed by said aircraft.

5. The arrangement according to claim 1, wherein said decoy is detached from said aircraft.

6. The arrangement according to claim 1, wherein said decoy is discharged from said aircraft during the flight.

7. The arrangement according to claim 1, wherein said threat signal is a radar signal.

8. The arrangement according to claim 1, wherein said signal processor further adds a feedback loop prevention code to said decoy relay signal.

9. The arrangement according to claim 8, wherein said feedback loop prevention code is selected from the list consisting of:

a direction of said decoy relay signal; and a type of modulation of said decoy relay signal.

10. The arrangement according to claim 1, wherein said signal processor compensates for inaccuracies in the conversion of said decoy relay signal to said decoy signal at said decoy.

11. The arrangement according to claim 10, wherein said signal processor compensates for inaccuracies by calibrating said decoy relay signal in accordance with a test signal transmitted by said decoy relay.

12. The arrangement according to claim 1, wherein said aircraft transmitter further transmits a reference signal to said decoy, and wherein said frequency converter converts said decoy relay signal into said decoy signal using said reference signal.

13. A method for generating a decoy signal with an aircraft having at least one decoy isolated from said aircraft, the method comprising the procedures of:

detecting a threat signal from a threat source at said aircraft;

producing a decoy relay signal based on said detected threat signal, said decoy relay signal having a frequency which is significantly lower than the frequency of said threat signal, and which is slowly attenuated through air;

transmitting said decoy relay signal from said aircraft to said decoy;

converting said received decoy relay signal to a decoy signal at said decoy; and transmitting said decoy signal from said decoy.

14. The method according to claim 13, wherein the frequency of said decoy relay signal is between approximately 2-4 GHz.

15. The method according to claim 13, wherein said decoy signal is transmitted at an intensity which is greater than the intensity of the reflection of said threat signal reflecting from said aircraft.

16. The method according to claim 13, wherein said threat signal is a radar signal.

17. The method according to claim 13, further including adding a feedback loop prevention code to said decoy relay signal.

18. The method according to claim 17, wherein said feedback loop prevention code is selected from the list consisting of:

a direction of said decoy relay signal; and a type of modulation of said decoy relay signal.

19. The method according to claim 13, wherein said procedure of producing a decoy relay signal includes compensating for inaccuracies in the conversion of said decoy relay signal to said decoy signal at said decoy.

20. The method according to claim 19, wherein said signal processor compensates for inaccuracies by calibrating said decoy relay signal in accordance with a test signal transmitted by said decoy.

21. The method according to claim 13, wherein said aircraft transmitter further transmits a reference signal to said decoy, and wherein said frequency converter converts said decoy relay signal into said decoy signal using said reference signal.

* * * * *

UNITED STATES PATENT AND TRADEMARK OFFICE

CERTIFICATE OF CORRECTION

PATENT NO. : 7,982,655 B2
APPLICATION NO. : 12/992485
DATED : July 19, 2011
INVENTOR(S) : Shlomo Tangy It is certified that error appears in the above-identified patent and that said Letters Patent is hereby corrected as shown below:

Title Page: should read

Item (75) - Inventors: delete "Dov Zahavi"

Signed and Sealed this
Thirtieth Day of August, 2011

David J. Kappos

David J. Kappos
*Director of the United States Patent and Trademark Office*